US007100583B2

(12) United States Patent
Lu

(10) Patent No.: US 7,100,583 B2
(45) Date of Patent: Sep. 5, 2006

(54) FILTER SCREEN AND THE APPARATUS FOR AIDING VEHICLE FUEL COMBUSTION AND PURIFYING EXHAUSTING GAS USING SAID FILTER SCREEN

(75) Inventor: Wen-Pin Lu, Taipei (TW)

(73) Assignee: Eternity Trading Co., Ltd., Taipei (TW)

( * ) Notice: Subject to any disclaimer, the term of this patent is extended or adjusted under 35 U.S.C. 154(b) by 4 days.

(21) Appl. No.: 10/806,442

(22) Filed: Mar. 23, 2004

(65) Prior Publication Data

US 2006/0032483 A1 Feb. 16, 2006

(51) Int. Cl.
*F02M 33/00* (2006.01)

(52) U.S. Cl. ..... 123/536; 123/539

(58) Field of Classification Search ..... 123/536–539; 95/3; 361/230
See application file for complete search history.

(56) References Cited

U.S. PATENT DOCUMENTS

RE30,826 E * 12/1981 Laws ..... 361/230
5,010,869 A * 4/1991 Lee ..... 123/539
5,873,353 A * 2/1999 Makita ..... 123/538
6,021,745 A * 2/2000 Watson ..... 123/1 A
6,024,073 A * 2/2000 Butt ..... 123/538
6,450,155 B1 * 9/2002 Arkfeld ..... 123/538
6,623,544 B1 * 9/2003 Kaura ..... 95/3
6,675,780 B1 * 1/2004 Wendels et al. ..... 123/536
6,691,927 B1 * 2/2004 Malloy ..... 239/3

* cited by examiner

*Primary Examiner*—Marguerite McMahon
(74) *Attorney, Agent, or Firm*—Dennison, Schultz, Dougherty & MacDonald

(57) ABSTRACT

Disclosed is a filter screen and the apparatus for aiding vehicle fuel combustion and purifying exhaust gas using said filter screen which has a metallic screen body treated in a treatment tank containing a discharge electrode plate and a receiving electrode plate both formed of mineral plate so as to have a memorized wave of wave length ranging 5 μm~20 μm. When placed in various environments, the filter screen is able to negatively ionize the ions in the air passing therethrough by releasing an energy wave motion so as to recover the air into its original pure state thereby improving the quality of the air and enhance the human health.

3 Claims, 9 Drawing Sheets

FILTER SCREEN AND THE APPARATUS FOR AIDING VEHICLE FUEL COMBUSTION AND PURIFYING EXHAUSTING GAS USING SAID FILTER SCREEN

BACKGROUND OF THE INVENTION

1. Field of the Invention

The present invention relates to a filter screen, and more particularly, to an air purification screen with which the quality of the air can be purified to its natural state to contain more negative irons so as to improve human health, and the apparatus for aiding vehicle fuel combustion and purifying exhaust gas using this filter to improve efficiency of fuel combustion. By using this filter screen, the perfect combustion of the fuel can be attained through irradiation of far infrared ray from active sphere balls on the fuel flowing through the apparatus to reduce the molecular size of the fuel, and supplying the purified air by negative ion inductors.

2. Description of the Prior Art

As SARS rapidly spreads from China to all over the world, it caused a panic everywhere. It is recommended by all governments in the world to cover your mouth and nose with a mask, to keep your hand clean and to intensify your immunity against virus of SARS to minimize any possibility of infection, etc. before the discover of effective vaccine. It is a pity that the investigation on the filtering effect of 90% of masks on the market is proved to be insufficient to keep out infectious particles in the air.

On the other hand, the recently developed air filters imposing an activated charcoal layer is proved to be invalid for interrupting transmission of SARS' bacteria either.

It is reported that the source of environmental contamination is not caused by contaminated air itself, but instead, the contamination is brought about by the increase of positive ions in the atmosphere which has been contaminated by infectious bacterias. It is believed that pollinosis is caused by the fir, wood pollens, but actually it is the polluted dust particles in the air which stimulate the human nose when being inhaled that is the essential origin of allergic. Such allergic reaction to dust particles can be alleviated by supplying the fresh negatively ionized air which after being passed through the filter screen.

As it is well known that the filter screen of an air conditioner is only effective for eliminating the dust and the louse, but ineffective for improving quality of the air. The air released from the air conditioner can only contribute to giving the people staying in the room a cool feeling.

The greatest ecocatastrophes threating the human nowadays are water and air pollution. About 70% of the area of the globe is occupied by ocean, also 70~80% weight of human body is water, and especially air is indispensable. In order to solve the problem of conflict between environmental contamination inevitably caused by the development of high technical industries and establishment of a comfortable and wholesome world, it is important to improve the living quality for every person by overcoming at first surrounding air and water pollutions which have been annoying him/her.

There are several causes of water pollutions, among which the most predominate ones are discharging the industrial waste water, and discarding poultry and domestic animals excreta, or rubbish directly to water sources such as streams and rivers. Fluorine is added with little effect to city running water for trying to recover the confidence of consumers. People reply on spring water and distilled water on market as their drinking water, but for the regular domestic works, such as washing clothes, bathing and cleaning vegetables and fruits, etc. they still have to use the incompletely sterilized city running water so that they are by no means released from pollution in this respect.

In addition to this, exhausted poisonous gases discharged from various factories, carbon monoxide produced due to incompletely combusted automobile fuel further added to come to attack citizens' health as if they were confined in a sealed chamber filled with poisonous gases.

In order to rectify such worldwide problems of environmental contamination, the applicant for patent of the present invention, through a longterm effort of study and experiment, has succeeded in developing a filter screen and an apparatus of the present invention which at least will release people from wearing a gas mask when they are working on the street, or suffering from polluted water. However, the invention is disclosed hereinafter.

SUMMARY OF THE INVENTION

It is a first object of the present invention to provide a filter screen which is formed of a metallic screen treated in a tank containing a discharging electrode plate and a receiving electrode plate both made of meneral plate so as to have a memorized wave of length ranging from 5 μm to 20 μm.

It is a second object of the present invention to provide a filter screen capable of making a certain wave motion (negatively ionizing) in the atmosphere so as to recover the atmospheric condition once has been damaged by the positive ions by transferring the contaminated positive ions into negative ions using the filter screen of the present invention.

It is a third object of the present invention to provide a filter screen capable of emitting a wave within the range of 5 μm~20 μm wave length which is suitable for growth of all kinds of animals and plants. The existing ions in the air can easily absorb even the weakest wave energy of said wave with resonance and cause the air to recover its natural pure state.

It is a fourth object of the present invention to provide a filter screen which can be attached to an ordinary mask behind the non woven activated charcoal layer so as to effectively filter away the infectious bacterias floating in the air with this metallic screen inductor.

It is a fifth object of the present invention to provide a filter screen which is applicable for air treating for internal combustion engines so as to attain the aims of improving fuel efficiency and cleaning the exhaust gases.

Besides, it can be applicable for the building air conditioner to purify the room air by refraining fro increase of bacterias and improving running efficiency of the air conditioner. Moreover, it can prominently improve the growth of plants in the greenhouse when it is used in the warm wind blower.

It is a sixth object of the present invention to provide a filter screen as an apparatus for aiding vehicle fuel combustion and purifying exhaust gas so as to achieve the perfect combustion of the fuel through irradiation of activated ball type far infrared ray on the fuel flowing through the apparatus so as to reduce the air molecules, and supply the purified air for combustion by negative ion inductors.

It is a seventh object of the present invention to provide an apparatus for aiding vehicle fuel combustion and purifying exhaust gas with which the molecules of the fuel may be further decomposed so as to perform perfect combustion and improve the quality of the surrounding atmosphere.

For fuller understanding of the nature, characteristics and objects of the invention, reference should be made to the following detailed description, taken in conjunction with the accompanying drawings.

DETAILED DESCRIPTION OF THE PREFERRED EMBODIMENTS

Figure 1:
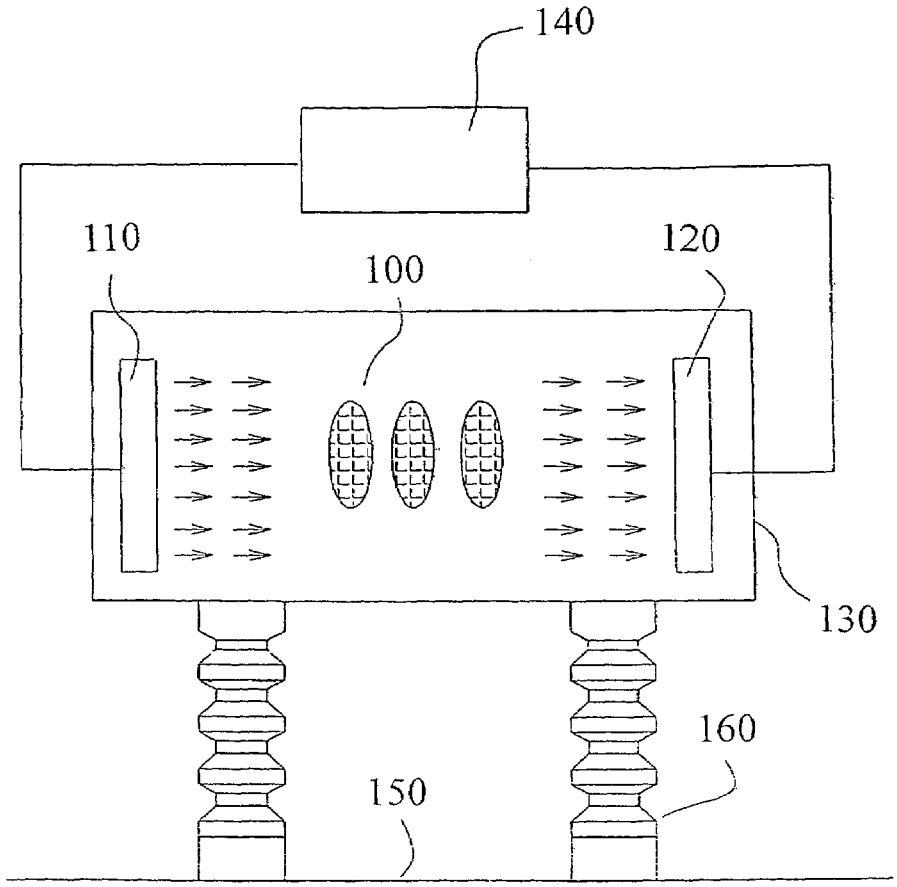
FIG. 1 is a schematic view showing the process of electrical treatment on the filter screen of the present invention.

Referring to FIG. 1, the filter screen of the present invention is a metallic screen 100 which is treated in a treating tank 130 made of mineral plate and having a plate type discharge electrode 110 and a plate type receiving electrode 120. The discharge electrode 110 and the receiving electrode 120 are connected to a special high voltage charger 140 respectively to be charged with a high voltage current. The bottom portion of the treating tank 130 is insulated from a platform 150 with a high voltage insulator 160. With this structure, the discharging electrode 110 and the receiving electrode 120 can pass through the charging current of the high voltage charger 140 so as to electrically treat the metallic screen interposed therebetween so as to form into the aforesaid filter screen 100 having a memorizied wave length in the range of 5 μm~20 μm.

The above mentioned mineral plate is made of ceramic capable of irradiating a far infrared ray.

The filter screen 100 made as such is capable of negatively ionizing the ions in the air flowing therethrough so as to purify the air into the natural state and improve the quality of the air and health of human being by releasing the energy wave in the above defined range of wave length when being applied to various environments.

The example of application of the filter screen 100 according to the present invention will be described hereinafter.

Figure 2:
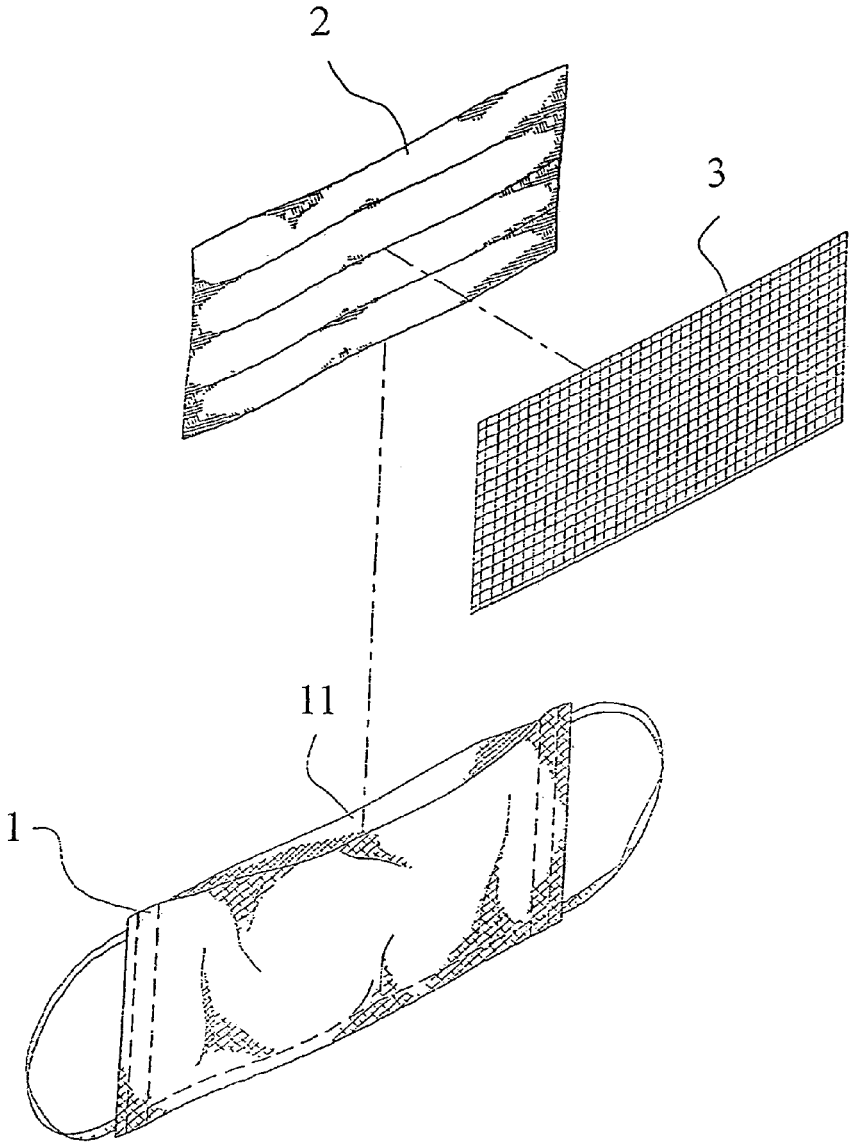
FIG. 2 is an exploded view showing how the filter screen of the present invention is used on a mask.

Referring to FIG. 2, the mask has a cover 1 made of non woven cloth as its main body, and a pocket 11 is provided behind the cover 1. An activated charcoal layer 2 is provided behind a non woven cloth layer 12 within the air inlet of the pocket 11. The filter screen 100 of the present invention is provided behind the activated charcoal layer 2. The filter screen 3 can irradiate energy wave of wave length in the range of from 5 μm~20 μm, in so as to negatively ionize the air passing therethrough because the filter screen 3 has been electrically treated in the tank made of mineral plate.

Figure 3:
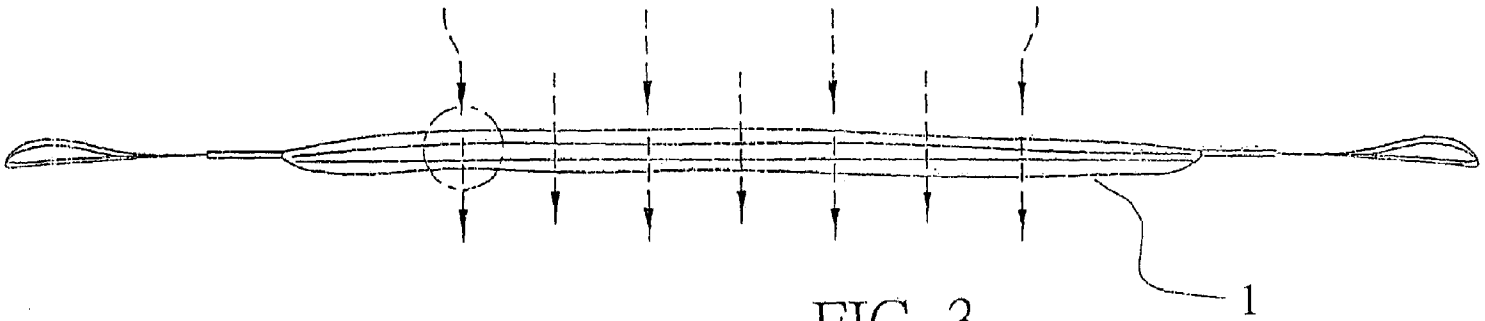
FIG. 3 is a cross-sectional view of a mask in which the filter screen of the present invention is included.
Figure 4:
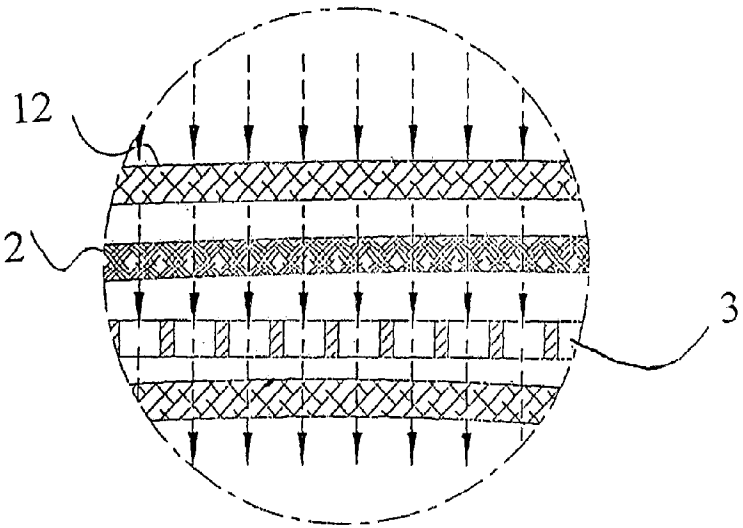
FIG. 4 is a fractional enlarged view of FIG. 2.

Referring to FIGS. 3 and 4, when the user wears the mask, the air inhaled from the nose and mouth passes through the non woven cloth layer 12 for the first filtering stage, then passes through the activated charcoal layer 2 for eliminating the polluted air as the second filtering stage, and then passes through the filter screen 3 as the last filtering stage to negatively ionize the air so as to supply the wholesome purified air into the users' lungs thereby avoiding invasion of the infectious bacterias into the users' bodies.

Figure 5:
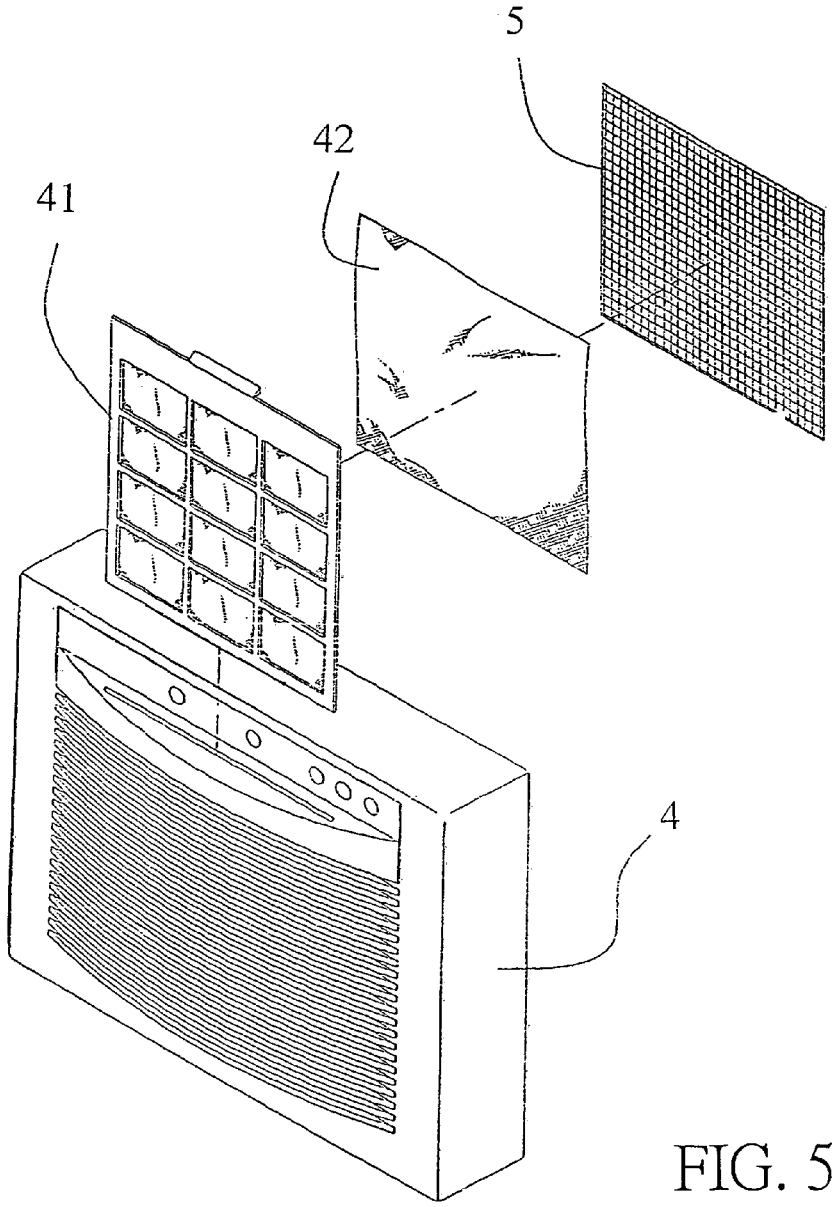
FIG. 5 is a three-dimensional exploded view of a room air filter using the filter screen of the present invention.

As shown in FIG. 5, the filter screen of the present invention may be equipped in the room air filter 4, wherein a common filter screen 41 is provided in front of the air path of the air filter 4, an activated charcoal layer 42 is provided behind the common filter screen 41, and the filter screen 5 of the present invention. 5 of the present invention is equipped behind the activated charcoal layer 42. With this scheme, the air flowing through the filter screen 5 may be negatively ionized so as to supply natural and clean air into the room thereby maintaining the room in a clean and non-contaminated state.

Figure 6:
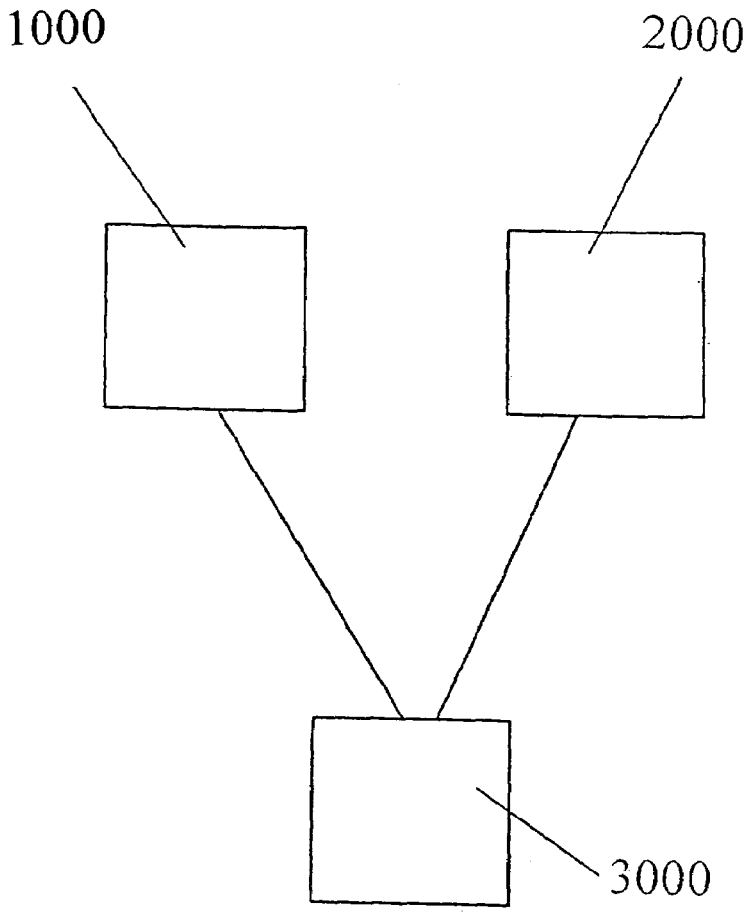
FIG. 6 is a block diagram of the present invention.

Referring to FIG. 6, the block diagram of the present invention, the apparatus for aiding vehicle fuel combustion and purifying exhaust gas comprises a fuel activation device 1000 and an air purification device 2000. By means of employing the fuel activation device 1000, the fuel supplied into the engine 3000 may be more activated, and by conducting the air to pass through the air purification device 2000, the air entering the engine 3000 may be more purified so that the fuel combustion will be more perfect to reduce the air pollution.

Figure 7:
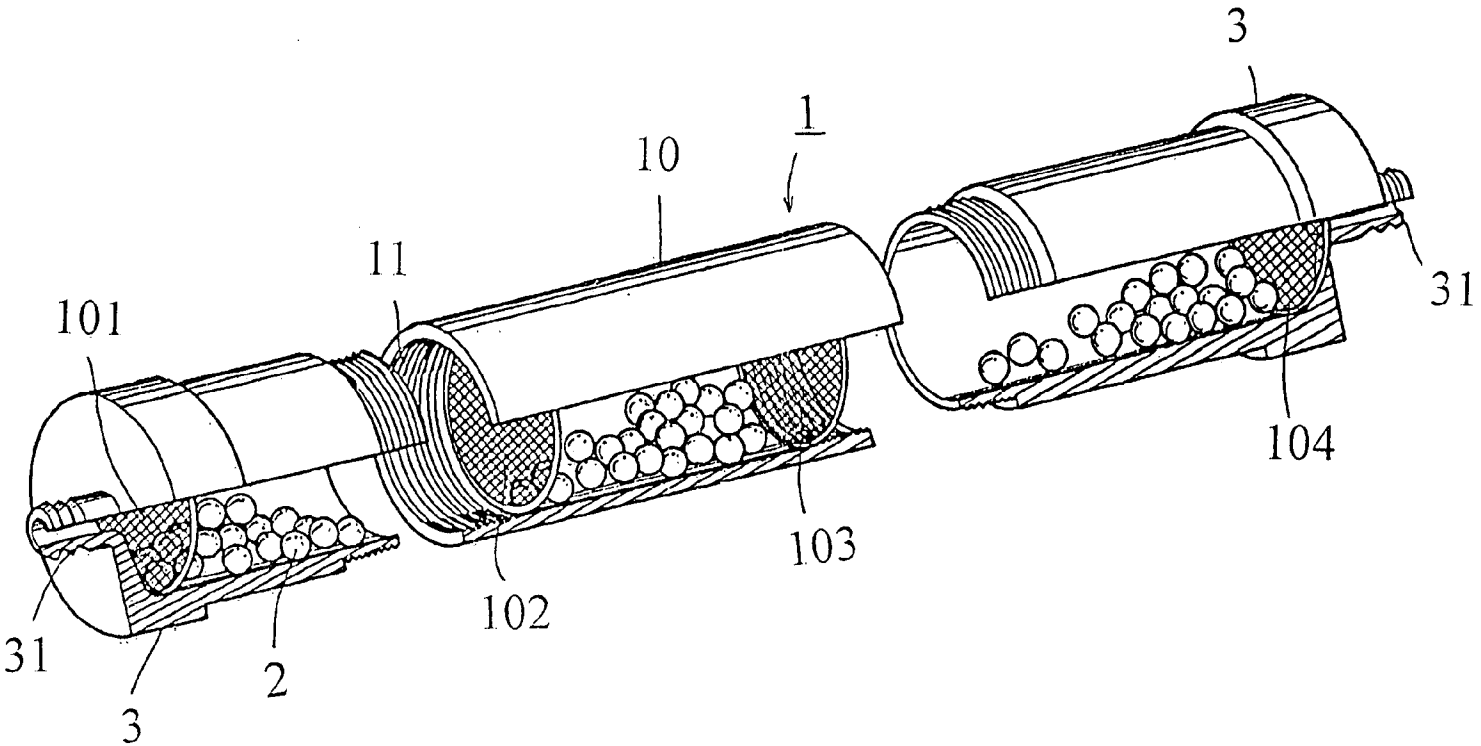
FIG. 7 is an exploded view of the assembly of the present invention.

As shown in FIG. 7, the fuel activation device 1000 is composed of a main body 1 and a plurality of active sphere balls 2 accommodated in the main body 1. The main body 1 is preferably made of a stainless steel hollow tube with its both ends opened, and structured in multi-sectionalized segments or multi-bushing series with a straight tube part 10 in the middle with two joints 3 provided at the both ends. The inner portion of the main body 1 is separated by nets 101, 102, 103, and 104 into proper number of compartments for accommodating proper number of active sphere balls 2 made of materials capable of irradiating a far infrared ray, such as ceramic, titanium dioxide ($TiO_2$), and rare metals such as Manganese (Mn); Magnesium (Mg) mixed and pressed with special stone powder emittable of a strong far infrared ray, and then heated at a temperature of 1300° C. so as to have the ability of far infrared ray radiation. The composition of an active sphere ball 2 is: $SiO_2$ 29%~38%, $TiO_2$ 35%~46%, Mn 21%~29%, Mg 2%~4%, all in weight percentage, and special stone powder 7%~15% in weight percentage consisting at least one element selected from the group including Selenium (Se), Lanthanum (La), Molybdenulll (Mo), Nickel (Ni), and Aluminum (Al). A voltage of 5 mv is impressed on a 5 g weight sphere ball 2 to irradiate a far infrared ray of wave length 4–14 μm thereby converting the optical energy to electro-chemical energy so as to collide with, and activate the fuel flowing through.

Figure 8:
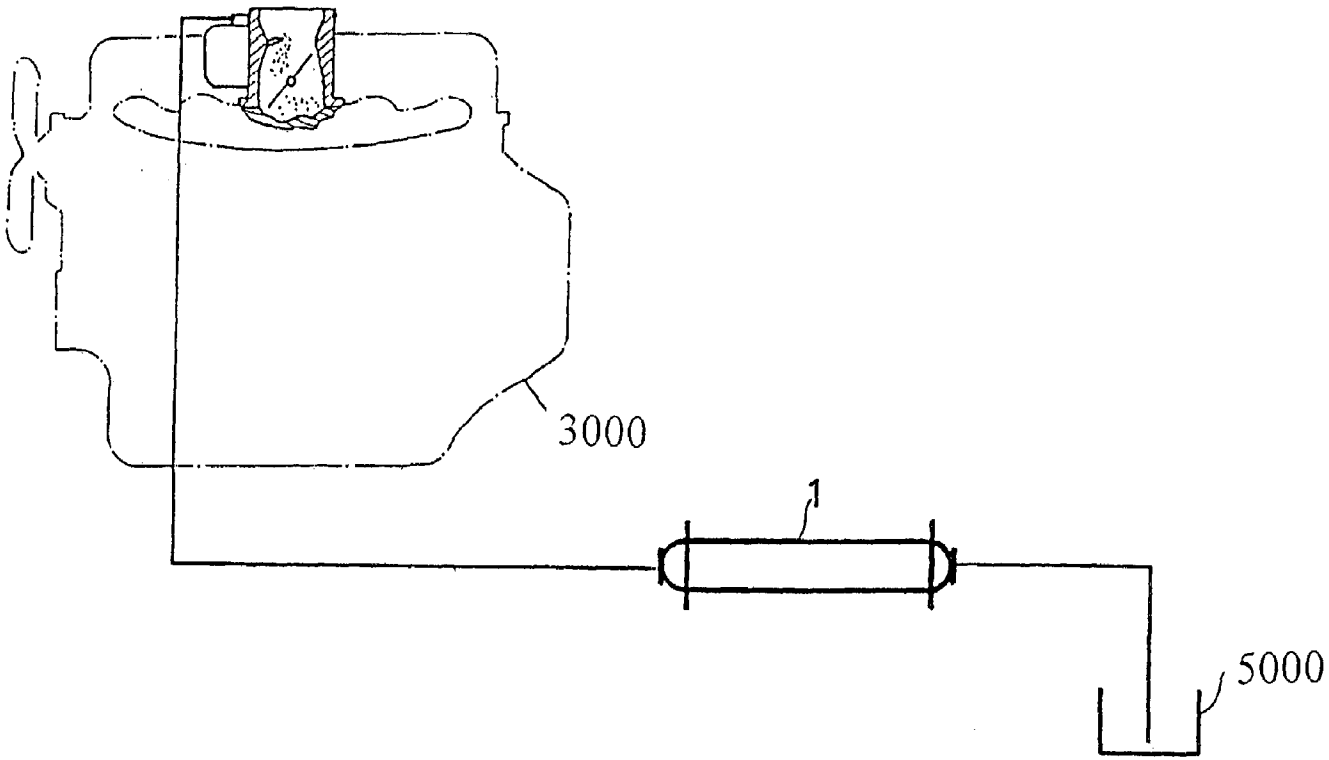
FIG. 8 is a schematic view illustrating how the apparatus of the present invention is used for activating a fuel oil.

After inserting the nets 101, 102 . . . into, and accommodating active sphere balls 2 in the main body 1, the main body 1 is connected with the joint 3 with the screw threads 11 provided at the two terminals of its middle tube. The joint 3 is a T-shaped screw combining part with its other end formed into a tube coupling 31 thereby providing a means for connecting with a soft transmission conduit that provides a smooth passage for the fuel. This soft transmission conduit is connected between a fuel tank 5000 and the engine 3000 when activating the fuel as shown in FIG. 8.

Figure 9:
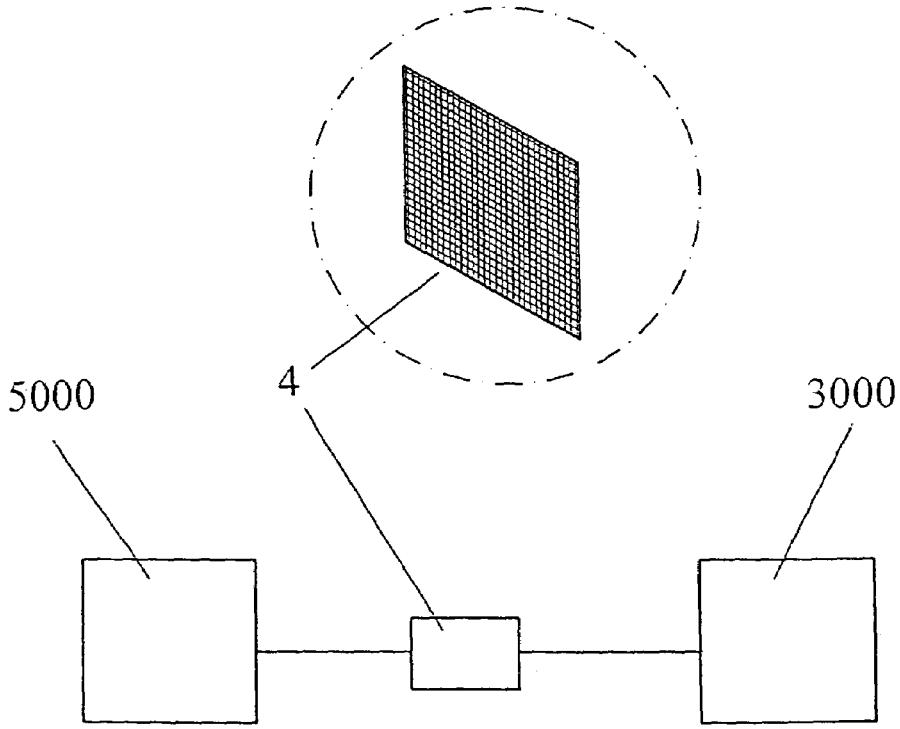
FIG. 9 is a schematic view showing the arrangement of each part of the apparatus according to the present invention when used for purifying air.
Figure 10:
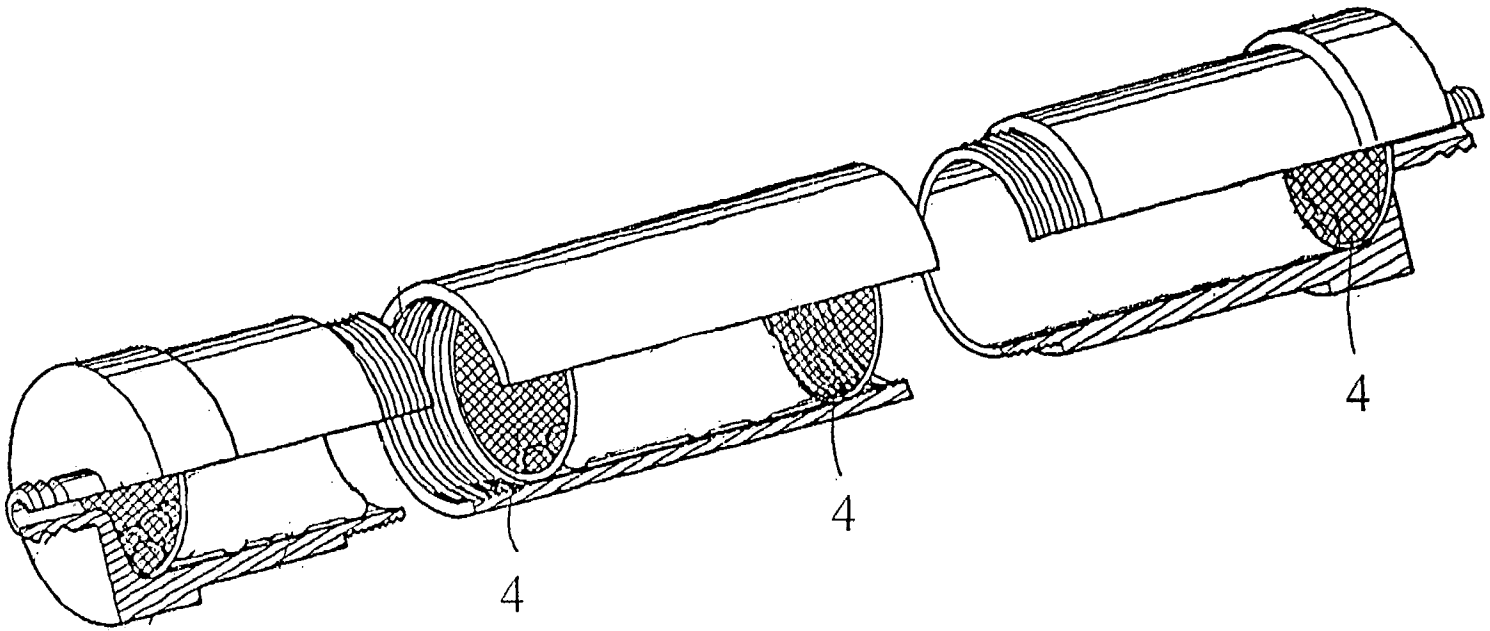
FIG. 10 is a three dimensional view of FIG. 9.

Referring to FIG. 9, the air purification device 2000 has an aforesaid filter screen 4 interposed in the conduit which interconnects the air filter 4000 and the engine 3000. The metallic filter screen 4 as described above, may be inserted into the main body of the conduit which has coupling joint at both ends. Being formed with a natural mineral substance, this metallic screen 4 is able to emit an electrical wave of a wave length 5 μm~20 μm to negatively ionize the air. With this treatment by electrical wave, the air entering the engine recovers its clean state without mixing with any pollution particles.

Accordingly, the apparatus for aiding vehicle fuel combustion and exhaust gas purification is very effective for activating the fuel before its combustion. When the fuel flows through the apparatus, $SO_2$ or molecules which are easy to form into CO considered to be difficult to decompose are activated and decomposed by a series of chemical reaction to lose the poisonousness. Further to this, since the air supplied for aiding the fuel combustion in the engine has been already purified when it flows through the negative ion inductor (the filter screen) 4 to perform perfect combustion, the exhaust gas of the engine no more contains those poisonous and disgusting $SO_2$ or CO gases thereby the object of improving the quality of surrounding atmosphere can be achieved.

It is noted from the above description that by employing the filter screen to the apparatus for aiding vehicle fuel combustion and exhaust gas purification according to the present invention is surely effective for activating the molecules of the fuel oil by irradiating with a far infrared ray emitted by the active sphere balls of the apparatus so as to convert the optical energy into electro chemical energy thereby reducing the molecular size of fuel oil, and upgrading the quality of the air supplied for aiding fuel combustion. Accordingly, by utilizing the apparatus of the present invention, the long time disturbing problem of air pollution may be solved.

Performance Test Report

The filter screen and the apparatus for aiding vehicle fuel combustion and exhaust gas purification using said filter screen was tested at Automotive Research & Testing Center, the test data are enumerated in the enumerated in the appended test report sheets (1), (2) and (3).

Those who are skilled in the art will readily perceive how to modify the invention. Therefore the appended claims are to be construed to cover all equivalent structures which fall within the true scope and spirit of the invention.

TEST REPORT 1 (Translation)

Test Report No.: B92EG137 Test Date: 2003.11.11

| |
|---|
| Client: Yung Fueng Industrial Co., Ltd.<br>Address: 106, 11F #17 Sec. 3, Jien Ai Road, Da An District, Taipei, Taiwan |
| Test Executed By: Environmental Protection & Energy Control Test Division<br>Test Item: Light-Duty Diesel Vehicle Exhaust Emissions Test<br>Test Classification: Quality Control Test<br>Production Name: Light Duty Diesel Vehicle<br>Vehicle Model: KIA K2500 TURBO 2476 C.C. M52D<br>KNCSD013247968945 |

Issued by: ARTC (Automotive Research & Testing Center)
Address: No. 6, Lunkung, S. 7Rd., Lu-Kang Town, Changhwa Hsien, Taiwan R.O.C.
TEL.: (04) 7811222
FAX: (04) 7811333, 7811777

Light-Duty Diesel Vehicle Exhaust Emissions Test

Test Report No.: B92EG137
Test Date: 2003.11.10

Test Classification: Quality Control Test
Page 1 of 2

Production Identification Information

KIA

VIN Code: KNCSD013247968945

Vehicle Model: K2500 TURBO 2476C.C. M5

Engine No.: D4BH3611485

2 D Light-Duty Truck

Tire Type: 5,00R12-8PR

Engine Family: -D2.5D4BH-02-A3

Transmission:M5

Engine Type: L4

Odometer: 57km

Fuel Supply Type: Direct Injection

Test Condition

Atmosphere Temperature:22.6℃

Relative Humidity: 51%

Barometric Pressure: 761.8 mmHg

Idle Speed: 750rpm

Fuel: Standard 2D Diesel Oil

Soak Time: 28.5hr

Inertia Weight: 1761 Kg

Road Resistance:593.7N at 80km/hr

Tire Pressure: 3.6Kgf/cm$^2$

Coast-down Time: 8.23Sec (85~75km/hr)

Gear Shifting Point:

1→2 15km/hr

2→3 30km/hr

3→4 50km/hr

4→5 74km/hr

Test Standard and Procedure

Driving Cycle Test: The test procedure and method followed Taiwan EPA regulation of "The guidelines of application for the certificate of confirming engine family exhaust emission and vehicles and selective auditing of new vehicle in the second terms of exhaust emission control standards for diesel and alternative clean fuel-engine vehicles."

Test Instruments:

Classic Dynameter: SCHENCK 500/GS112/V200/K4000

Exhaust Analysis System: HORIBA MEXA-9200D

| | |
|---|---|
| Exhaust Sample System: HORIBA CVS-9300T | CO Analyzer: HORIBA A-120 |
| Exhaust Sample System: HORIBA CVS-9300T | HC Analyzer: HORIBA AIA-120 |
| PM Sample System: DLS-75 | $NO_x$ Analyzer: HORIBA CLA-150 |
| PM Balances: METLLER AT21 | $CH_4$ Analyzer: HORIBA GFA-120 |

Approved by:

C.S. Wang (Signature)

Light-Duty Diesel Vehicle Exhaust Emissions Test

Test Report No.: B92EG137
Test Date: 2003.11.10
Test Results:

Test Classification: Quality Control Test
Page 2 of 2

| EMISSION TEST RESULTS | | | | | |
|---|---|---|---|---|---|
| TEST ITEMS | | CO | NMHC | $NO_x$ | PM |
| | Test Data | 0.12g/km | 0.033g/km | 0.56g/km | 0.03g/km |
| Weight Method | Deterioration Factors | 1.200 | 1.000 | 1.000 | 1.500 |
| | Results | 014g/km | 0.033g/km | 0.56g/km | 0.05g/km |

Remarks:

1. The related elements of vehicle pollution

A. Catalyst converter B. Exhaust gas recycling system C. Others (electronic control)

2. Coolant

R134 a

3. If noticed by "O.K.", it means "has passed the standard." If noticed by "N.G.", it means "do not have passed the standard."

4. The approved certificate provided by client is: A3D570501C-1; the type of Engine is: D2.5D4BH-02-A3.

5. This test report is responsible only to the car that has been tested.

TEST REPORT 2 (Translation)

Test Report No.: B92EG139 Test Date: 2003.11.13

| |
|---|
| Client: Yung Fueng Industrial Co., Ltd.<br>Address: No. 98, Sec. 1, Kee Lung Road, Taipei Taiwan |
| Test Executed By: Environmental Protection & Energy Control Test Division<br>Test Item: Light-Duty Diesel Vehicle Exhaust Emissions Test<br>Test Classification: Research Test<br>Production Name: Light Duty Diesel Vehicle<br>Vehicle Model: KIA K2500 TURBO 2476 C.C. M52D<br>KNCSD013247968945 |

Issued by: ARTC (Automotive Research & Testing Center)
Address: No. 6, Lunkung, S. 7Rd., Lu-Kang Town, Changhwa Hsien, Taiwan R.O.C.
TEL.: (04) 7811222
FAX: (04) 7811333, 7811777

Light-Duty Diesel Vehicle Exhaust Emissions Test

Test Report No.: B92EG139
Test Date: 2003.11.12

Test Classification: Research Test
Page 1 of 2

Production Identification Information

KIA

VIN Code: KNCSD013247968945

Vehicle Model: K2500 TURBO 2476C.C. M5

Engine No.: D4BH3611485

2 D Light-Duty Truck

Tire Type: 5,00R12-8PR

Engine Family: -

Transmission:M5

Engine Type: L4

Odometer: 139km

Fuel Supply Type: Direct Injection

Test Condition

Atmosphere Temperature:20.7℃

Relative Humidity: 50%

Barometric Pressure: 767.6 mmHg

Idle Speed: 750rpm

Fuel: Standard 2D Diesel Oil

Soak Time: 23.5hr

Inertia Weight: 1761 Kg

Road Resistance:593.7N at 80km/hr

Tire Pressure: 3.6Kgf/cm$^2$

Coast-down Time: 8.23Sec (85~75km/hr)

Gear Shifting Point:

1→2 15km/hr

2→3 30km/hr

3→4 50km/hr

4→5 74km/hr

Test Standard and Procedure

Driving Cycle Test: The test procedure and method followed Taiwan EPA regulation of "The guidelines of application for the certificate of confirming engine family exhaust emission and vehicles and selective auditing of new vehicle in the second terms of exhaust emission control standards for diesel and alternative clean fuel-engine vehicles."

Test Instruments:

Classic Dynameter:

SCHENCK 500/GS112/V200/K4000

Exhaust Sample System: HORIBA CVS-9300T

Exhaust Analysis System: HORIBA MEXA-9200D

CO Analyzer: HORIBA A-120

HC Analyzer: HORIBA AIA-120

Exhaust Sample System: HORIBA CVS-9300T

PM Sample System: DLS-75

PM Balances: METLLER AT21

$NO_x$ Analyzer: HORIBA CLA-150

$CH_4$ Analyzer: HORIBA GFA-120

Approved by:

C.S. Wang (Signature)

Light-Duty Diesel Vehicle Exhaust Emissions Test

Test Report No.: B92EG139
Test Date: 2003.11.12
Test Classification: Research Test
Page 2 of 2

Test Results:

| EMISSION TEST RESULTS | | | | | |
|---|---|---|---|---|---|
| TEST ITEMS | | CO | NMHC | $NO_x$ | PM |
| | Test Data | 0.17g/km | 0.024g/km | 0.52g/km | 0.01g/km |
| Weight Method | Deterioration Factors | | | | |
| | Results | 0.17g/km | 0.024g/km | 0.52g/km | 0.01g/km |

Remarks:

1. The related elements of vehicle pollution

A. Catalyst converter B. Exhaust gas recycling system C. Others (electronic control)

2. Coolant

R134 a

3. If noticed by "O.K.", it means "has passed the standard." If noticed by "N.G.", it means "do not have passed the standard."

4. The active filtering net is added to air filter, and the active filter is added to inlet oil pipe.

5. This test report is responsible only to the car that has been tested.

TEST REPORT 3 (Translation)

Test Report No.: B92EG143 Test Date: 2003.10.29

| |
|---|
| Client: Chio Hung Trading Co., Ltd.<br>Address: 3F, No. 31, Lane 67, Lin Hsen North Road, Taipei, Taiwan |
| Test Executed By: Environmental Protection & Energy Control Test Division<br>Test Item: Gasoline Vehicle Exhaust Emissions Test<br>Test Classification: Research Test<br>Production Name: Gasoline Vehicle<br>Vehicle Model: Taipla V20DNL 2, OL A4 4D<br>C20SED099850 |

Issued by: ARTC (Automotive Research & Testing Center)
Address: No. 6, Lunkung, S. 7Rd., Lu-Kang Town, Changhwa Hsien, Taiwan R.O.C.
TEL.: (04) 7811222
FAX: (04) 7811333, 7811777

Gasoline Vehicle Exhaust Emissions Test

Test Report No.: B92EG143
Test Date: 2003.10.28

Test Classification: Research Test
Page 1 of 2

Production Identification Information

Taipla

Vehicle Model: V20DNL 2,0 L A4

4D Gasoline Vehicle

Engine Family: --

Fuel Supply Type: Direct Injection

VIN Code: V20DNL001430

Engine No.: C20SED099850

Tire Type: 205/65R15

Transmission: A4

Odometer: 1305km

Test Condition

Atmosphere Temperature:21.1℃

Barometric Pressure: 767.3 mmHg

Fuel: 95 Leadless gasoline for test use

Inertia Weight: 1613 Kg

Tire Pressure: 2.1Kgf/cm$^2$

Relative Humidity: 50%

Idle Speed: 730rpm

Soak Time: 13.0hr

Road Resistance:471.1N at 80km/hr

Coast-down Time: 9.51Sec (85~75km/hr)

Gear Shifting :

Test Standard and Procedure

1. Driving Cycle Test, idle running, fuel tank and EEC exhaust emissions: followed Taiwan EPA regulation of "The guidelines of application for the certificate of confirming engine family exhaust emission and vehicles and selective auditing of new vehicle in the second terms of exhaust emission control standards for diesel and alternative clean fuel-engine vehicles."
2. Crank Case (PVC): Followed CNS 11496 D3166 Standard

Test Instrument:

Classic Dynameter:

SCHENCK 500/GS112/V200/K4000

Exhaust Sample System: HORIBA MEXA-9200D

CO Analyzer: HORIBA AIA-120

HC Analyzer: HORIBA FIA-120

$NO_x$ Analyzer: HORIBA CLA-150

Emission Sample System: HORIBA CVS-9300T

Idle Speed Analyzer: HORIBA MEXA 574GE $CH_4$ Analyzer: HORIBA GFA-120

Approved by:

C.S. Wang (Signature)

Gasoline Vehicle Exhaust Emissions Test

Test Report No.: B92EG143
Test Date: 2003.10.28
Test Results:

Test Classification: Research Test
Page 2 of 2

| EXHAUST EMISSION TEST RESULTS | | | | | |
|---|---|---|---|---|---|
| TEST ITEMS | | CO | NMHC | $NO_x$ | THC |
| | Test Data | 1.28g/km | 0.130g/km | 0.08g/km | - |
| Weight Method | Deterioration Factors | - | - | - | - |
| | Results | 1.28g/km | 0.130g/km | 0.08g/km | - |
| Concentration at idle speed | Test Data | 0.0% | | | 2ppm |
| | Modified Data | 0.0% | | | 2ppm |
| E.E.C. (SHED) | Test Data | | | | |
| | Deterioration Factors | | | | |
| | Results | | | | |
| P.C. V. | Results | | | | |

Remarks:

1. The related elements of vehicle pollution

A. EEC system B. PCV system C. Catalyst converter

D. Exhaust gas recycling system E. Oxygen tester

2. Coolant

R134 a

3. The active filtering net is added to air filter, and the active filter is added to inlet oil pipe.

This test report is responsible only to the car that has been tested.

VEHICLE ENERGY CONSUMPTION TEST REPORT

| | |
|---|---|
| Test Report No.: B92EG143<br>Client: Chio Hung Trading Co., Ltd.<br>Taipla<br><br>Vehicle Model: V20DNL 2.0 L A4<br><br>4 Sedan<br><br>Engine No.: C20SED099850<br>Total Cylinder Volume: 1998c.c.<br>Idle Speed: 730rpm<br>Tire Pressure: 2.1kgf/cm$^2$<br>Inertia Weight: 1613Kg | Test Classification: Research Test<br>Test Date:10.28.2003<br>Engine Type: L4<br>Transmission:A4<br>Fuel:95 leadless gasoline for test<br>Atmosphere Temperature: 21.1℃<br>Relative Humidity: 50%<br>Barometric Pressure: 102.30kpa<br>Odometer: 1305Km |

ENERGY CONSUMPTION TEST RESULTS

| Test Item | Energy Consumption in Urban Area | Energy Consumption High Speed | Average Consumption Rate | Standard Energy Consumption Rate | Conclusion |
|---|---|---|---|---|---|
| Test Data | 8.74km/l | 14.87km/l | 10.7km/l | According to total cylinder volume 10.5km/l | For Research Only |
| | | | | According to inertia weight 8.7km/l | For Research Only |

Remarks:

1.This report is handled according to the test standard and method disclosed in Art. 4 and 5 of "Standard and Method of Test Management for Allowable Energy Consumption of Vehicle".

2. Art. 4 of "Standard and Method of Test Management for Allowable Energy Consumption of Vehicle" is: The cards manufactured or imported by a company must comply to the following energy consumption standard:

| Cylinder Volume (c.c.) | Under 1200 | 1201~1800 | 1800~2400 | 2401~3000 | 3001~3600 | 3601~4200 | Over 4000 |
|---|---|---|---|---|---|---|---|
| Energy Consumption Standard (Km/l) | 15.4 | 11.6 | 10.5 | 9.4 | 8.5 | 7.8 | 7.2 |

The car which had been tested and acknowledged to be complied with the following standard, and had obtained the energy consumption documents, can be sold till June, 30, 2005 without limitation due to above standards.

| Weight of Vehicle (Kg) | Under 104.6 | 1047~1276 | 1277~1496 | 1497~1726 | 1727~1956 | 1957~2176 | Over 2177 |
|---|---|---|---|---|---|---|---|
| Energy Consumption Standard (km/l) | 14.7 | 12.0 | 10.1 | 8.7 | 7.7 | 6.9 | 5.3 |

3. The test vehicle has equipped with EEC system, PCV system, catalyst converter, oxygen tester and exhaust gas recycling system.
4. If noticed by 'O.K.", it means has passed the standard. If noticed by 'N.G.", it means do not have passed the standard.
5. The active filtering net is added to sir filter, and the active filter is added to inlet oil pipe.
6. This test report is responsible only to the car THAT has bee tested.

Approved by:

C.S. Wang (Signature)

What is claimed is:

1. A filter having metallic screen body, treated for releasing an energy to negatively ionize the ions in the air, wherein said filter screen is formed of a metallic screen body treated in a treatment tank containing a discharge electrode plate and a receiving electrode plate having a wave length ranging from 5 μm–20 μm, said filter screen is able to negatively ionize the ions in the air passing therethrough by releasing an energy wave motion so as to recover the air into its original pure state thereby improving the quality of the air.

2. An apparatus for aiding vehicle fuel combustion and purifying exhaust gas comprising a fuel activation device and an air purification device, wherein said fuel activation device is composed of a tubular main body in communication with a fuel flow conduit and a plurality of active spherical balls accommodated in said tubular main body, said active spherical balls are immersed in the fuel flow completely so as to effectively activate the fuel, said air purification device is the filter screen as that of claim 1 interposed between the air filter and the engine.

3. The apparatus of claim 2, wherein said active spherical balls are formed of $SiO_2$, $TiO_2$, and Mn and Mg mixed and pressed with special stone powder emitted from a strong far infrared ray, and then heated to a temperature of 1300° C. so as to acquire the ability to irradiate a far infrared ray, the composition of said active spherical balls is (all in weight %): $SiO_2$ 29%–38%, $TiO_2$ 35%–46%, Mn 21%–29%, Mg 2%–4%, and 7–15% special stone powder consisting at least one element selected from the group of Se, La, Mo, Ni, and Al, being able to emit a far infrared ray of wave length 4 μm–14 μm with 5 mv of impressed voltage on 5 g of said active spherical ball.

* * * * *